United States Patent [19]

Satomoto et al.

[11] Patent Number: 4,767,296

[45] Date of Patent: Aug. 30, 1988

[54] TROCHOIDAL TOOTHED OIL PUMP WITH THIN DISCHARGE CHANNEL COMMUNICATING WITH DISCHARGE CHAMBER

[75] Inventors: Atsushi Satomoto; Takashi Nakagawa; Junichiro Sakurai, all of Toyota; Koji Morita, Kariya, all of Japan

[73] Assignee: Aisin Seiki Kabushiki Kaisha, Kariya, Japan

[21] Appl. No.: 32,958

[22] Filed: Mar. 31, 1987

Related U.S. Application Data

[63] Continuation of Ser. No. 791,385, Oct. 25, 1985, abandoned.

[30] Foreign Application Priority Data

Oct. 31, 1984 [JP] Japan ..... 59-231066

[51] Int. Cl.[4] ..... F04C 2/10

[52] U.S. Cl. ..... 418/171; 418/180

[58] Field of Search ..... 418/78, 166, 171, 180, 418/189

[56] References Cited

U.S. PATENT DOCUMENTS

| | | | |
|---|---|---|---|
| 2,684,637 | 7/1954 | Erikson | 418/180 |
| 3,072,067 | 1/1963 | Beller | 418/189 |
| 3,635,604 | 1/1972 | Petersen et al. | 418/171 |

FOREIGN PATENT DOCUMENTS

| | | | |
|---|---|---|---|
| 47-3052 | 1/1972 | Japan | 418/171 |
| 1271677 | 4/1972 | United Kingdom | 418/171 |

*Primary Examiner*—John J. Vrablik

*Attorney, Agent, or Firm*—Oblon, Fisher, Spivak, McClelland & Maier

[57] ABSTRACT

A trochoidal oil pump including a housing defining an internal space; an outer rotor fitted rotatably in the internal space of the housing and having internal teeth; an inner rotor having outer teeth meshing with the internal teeth of the outer rotor to define a sealed space therebetween; and suction and discharge chambers formed in the housing and opened into the internal space of the same. The discharge member is formed to begin at an angle l formed in the direction of forward rotation from the dedendum to the beginning portion of the discharge chamber extending in the direction of forward rotation and defined by the following relationship:

$$l_1 < l \leqq 70°,$$

where $l_1$, designates an angle taken in the direction of rotation from the dedendum of the inner rotor to the contact position, in which the outer rotor and the inner rotor have their addendums contacting at first, at the maximum volume of the sealed space. A thin channel communicating with the discharge chamber is so formed in the housing as to extend in a reverse direction of rotation from the position of the angle l.

5 Claims, 3 Drawing Sheets

TROCHOIDAL TOOTHED OIL PUMP WITH THIN DISCHARGE CHANNEL COMMUNICATING WITH DISCHARGE CHAMBER

This is a continuation of application Ser. No. 791,385, filed Oct. 25, 1985, now abandoned.

BACKGROUND OF THE INVENTION

1. Field of the Invention

The present invention relates to an oil pump for an engine lubricant and, more particularly, to a trochoidal oil pump for effecting pumping actions in accordance with changes in the capacity of a sealed space between inner and outer rotors.

2. Description of the Prior Art

One example of the oil pump of the above-specified kind is disclosed in Japanese Patent Laid-Open No. 58-35212. In this trochoidal oil pump, a housing is fixed to form an internal space together with the side of an engine block. As shown in FIG. 7, an annular outer rotor 50 is fitted rotatably in the internal space of said housing. In this outer rotor 50, there is fitted an inner rotor 51 which has a four-lobed trochoidal curve and which is formed with external teeth 51*a* meshing with the internal teeth 50*a* of said outer rotor 50. The inner rotor 51 is driven by a rotating shaft which is coupled thereto and borne by the aforementioned housing. Deeper than the bottom of the internal space of the housing, there are formed a suction chamber 52 and a discharge chamber 53, both of which communicate with the internal space of the housing. Oil is discharged in accordance with changes in the capacity of a sealed space (as hatched in the drawing) 54 which is defined by the internal teeth 50*a* and the external teeth 51*a*.

On the other hand, the oil pump disclosed in Japanese Patent Laid-Open No. 58-70014 is of the type, in which it is connected directly to a crankshaft having a multi-toothed trochoidal rotor. In the internal space of a housing, more specifically, there is rotatably fitted an annular outer rotor 60 which is shown in FIG. 8. In this outer rotor 60, there is fitted in inner rotor 61 which has its external teeth 61*a* meshing with the internal teeth 60*a* of the outer rotor 60. This inner rotor 61 is driven directly by the crankshaft. Deeper than the bottom of the internal space of the housing, are formed a suction chamber 62 and a discharge chamber 63, both of which communicate with the aforementioned internal space. Thus, oil is discharged to the discharge chamber 63 in accordance with changes in the volume of a sealed space (as hatched in the drawing), which is defined by the internal teeth 60*a* and the external teeth 61*a*.

The aforementioned oil pumps of the prior art will be described in connection with the example of FIG. 8 by way of example. The discharge chamber 63 is formed to extend in the direction of rotation (i.e., a counter-clockwise direction) from a contact position, in which the internal and external teeth come into first contact, with respect to the dedendum 65 (or 55 in the other example of the prior art shown in FIG. 7) of the inner rotor 61 at the maximum of the sealed space 64. In other words, the opening of the discharge chamber 63 into the internal space of the housing is formed to extend from the above-specified contact position 66 in the direction of rotation. In this oil pump of the prior art, however, as soon as the inner rotor 61 rotates, communication between the discharge chamber 63 and the sealed space 64 is instantly initiated to have its area enlarged abruptly, and the discharge chamber 63 is formed axially within the housing. As a result, under the influence of the discharge pressure of the chamber 63, the oil flows back from the discharge chamber 63 into the sealed space 64 so that a higher peak pressure than the discharge pressure is built up with fluctuations in the sealed space 64. These pressure fluctuations propagate with the resultant fluctuations in the rotations of the two rotors, thus raising a problem in that noises or wear of the teeth are caused by the resonance or the like of the hydraulic circuit inclusive.

SUMMARY OF THE INVENTION

In view of the problem intrinsic to the aforementioned prior art, therefore, an object of the present invention is to provide a trochoidal oil pump in which it is possible to block back flow of the oil from the discharge chamber into the sealed space.

According to the technical means for solving the above-specified technical target, the discharge chamber is formed to extend over such an angle l formed in the direction of forward rotation from the dedendum of the inner rotor to the beginning portion of the discharge chamber extending in the direction of forward rotation and defined by the following relationship:

$$l_1 < l \leqq 70°$$

where $l_1$ designates an angle taken in the direction of rotation from the dedendum of the inner rotor to the contact position, in which the outer rotor and the inner rotor have their addendums contacting at first, at the maximum volume of the sealed space, and a thin channel communicating with the discharge chamber is so formed in the housing as to extend in the reverse direction of rotation from the position of the angle.

The sealed space has its capacity reduced without any communication with the discharge chamber, when the inner rotor rotates, and the oil corresponding to that reduction is confined to find no outlet so that the internal oil pressure is accumulated. By forming the thin channel communicating to the discharge chamber, however, the oil is progressively released from the sealed space into the discharge chamber so that its back flow from the discharge chamber into the sealed space can be blocked so as to prevent the pressure in the sealed space from fluctuating.

BRIEF DESCRIPTION OF THE DRAWINGS

Other objects, features and advantages of the present invention will become apparent from the following description taken in conjunction with the accompanying drawings, in which.

DESCRIPTION OF THE PREFERRED EMBODIMENTS

The present invention will be described in the following discussion in connection with the embodiments of the technical means with reference to the accompanying drawings.

Figure 1:
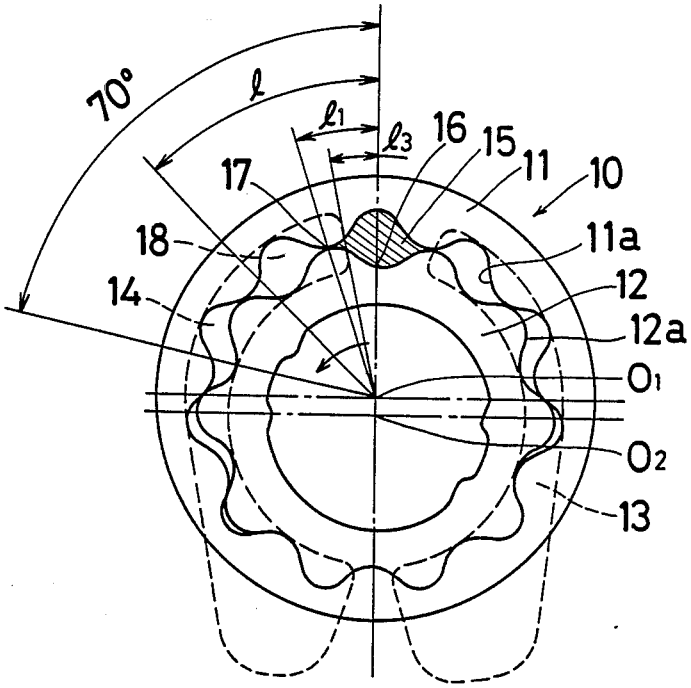
FIG. 1 is a sectional view showing an oil pump according to one embodiment of the present invention.

As shown in FIG. 1, an oil pump 10 includes an annular outer rotor 11 which is fitted rotatably in the internal space of a housing (although not shown). In this outer rotor 11, there is arranged an inner rotor 12 which has its external teeth 12*a* meshing with the internal teeth 11*a* of the outer rotor 11. In other words, the inner rotor 12 has a center of rotation $O_2$ which is eccentric to or offset from that $O_1$ of the outer rotor 11.

Figure 2:
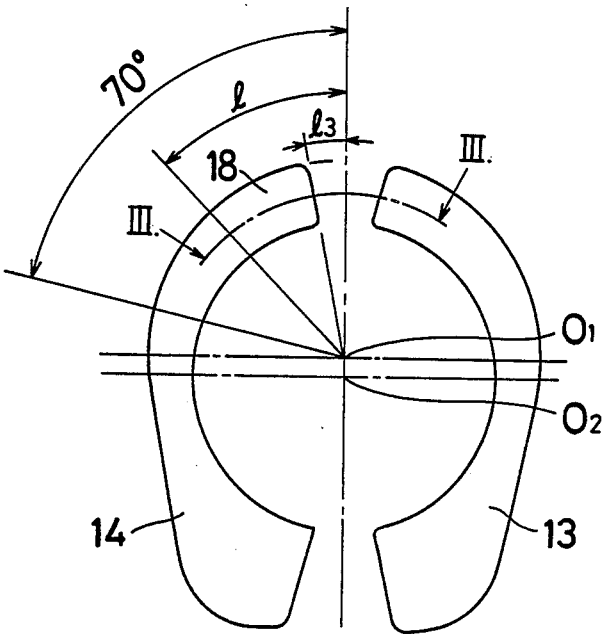
FIG. 2 is a schematic view showing the shapes of a suction chamber and a discharge chamber shown in FIG. 1.
Figure 3:
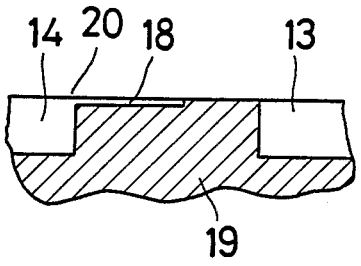
FIG. 3 is a sectional view taken along line III—III of FIG. 2.

The aforementioned discharge chamber 14 is formed to extend over an angle l formed in the direction of forward rotation from a standard point which comprises the dedendum 16 of the inner rotor 12 to the beginning portion of discharge chamber 14 extending in the direction of forward rotation and defined in the following:

$$l_1 < l \leqq 70°$$

where $l_1$ designates an angle taken in the direction of rotation from the dedendum 16 of the inner rotor 12 to the contact position 17, in which the outer rotor 11 and the inner rotor 12 have their addendums contacting at first, at the maximum of the sealed space 15 (as hatched in the drawing) which is defined by the external teeth 11*a* of the outer rotor 11 and the external teeth 12*a* of the inner rotor 12. Moreover, an arcuate shaped thin channel 18 communicating with the discharge chamber 14 is so formed in the housing as to extend in the reverse direction of rotation from the position of the angle l to the position of angle $l_3$ (where $l_3 < l_1$) thereby to communicate with the sealed space 15. In FIGS. 2 and 3 showing that thin channel 18, FIG. 2 is an external view showing the suction chamber 13 and the discharge chamber 14, and FIG. 3 is a sectional view taken along line III—III of FIG. 2. As is apparent from FIG. 3, the thin channel 18 communicating with the discharge chamber 14 opened into the internal space 20 of the housing 19 is formed so as to be shallow. Thanks to the formation of such thin channel 18, the communication between the sealed space 15 and the discharge chamber 14 can be established through the channel 18.

When the inner rotor 12 rotates, the sealed space 15 has its volume reduced to have internal oil pressure accumulated. The oil corresponding to the reduction in the capacity is allowed to flow out gradually via the thin channel 18 into the discharge chamber 14. As a result, the sealed space 15 is prevented from having abrupt communication with the discharge chamber 14 so that the back flow of the oil from the discharge chamber 14 to the sealed space 15 can be blocked so as to reduce the fluctuations in the pressure in the sealed space 15.

Figure 4:
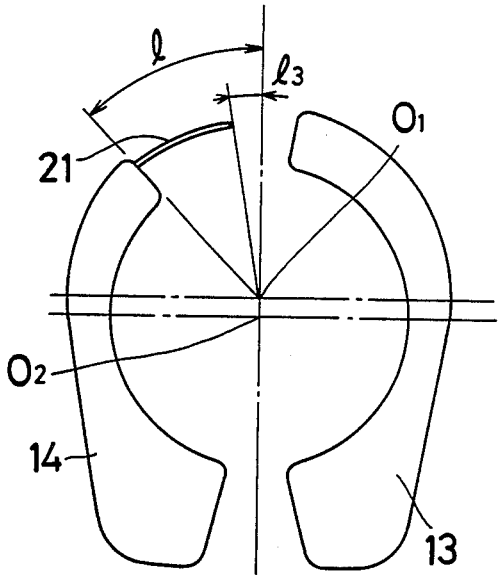
FIGS. 4 and 5 are schematic views corresponding to FIG. 2 but show modifications of a thin channel.
Figure 5:
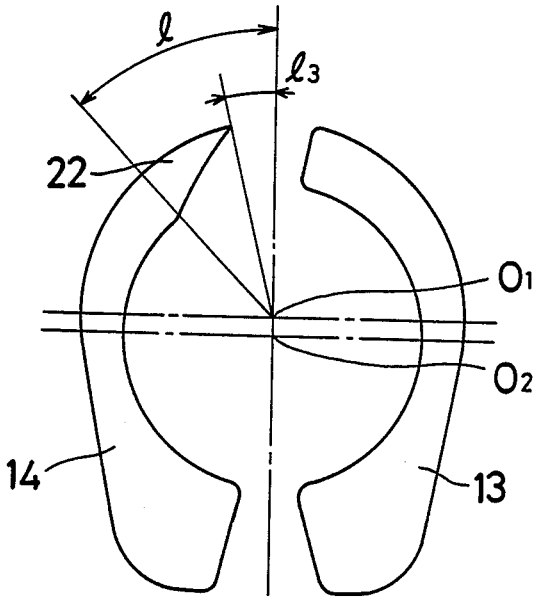
Figure 6:
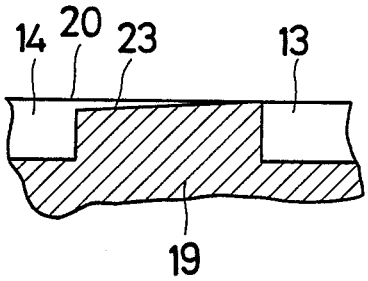
FIG. 6 is a sectional view corresponding to FIG. 3 but which shows another modification of the thin channel.
Figure 7:
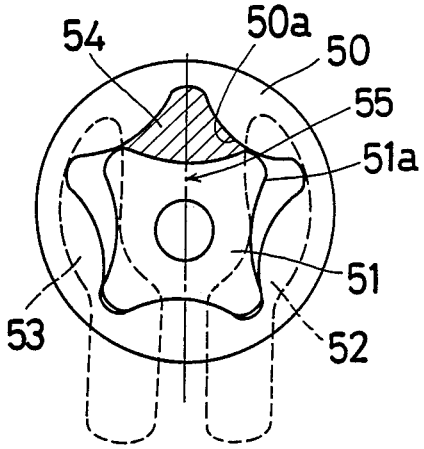
FIG. 7 Prior Art
FIGS. 7 and 8 are sectional views showing prior art oil pumps.
Figure 8:
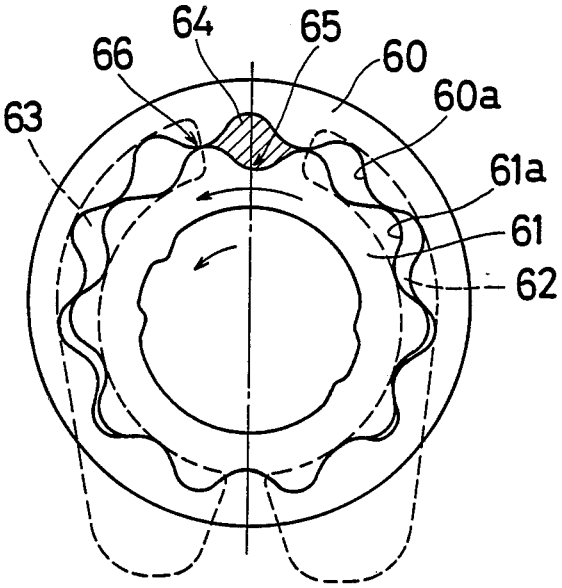
FIG. 8 Prior Art

FIGS. 4, 5 and 6 show the modifications of the thin channel 18 shown in FIGS. 2 and 3. A thin channel 21 shown in FIG. 4 is slot shaped so that it can be easily machined whereas thin channels 22 and 23 shown in FIGS. 5 and 6 are made to have their effective sectional areas varied. Specifically, the thin channel 22 of FIG. 5 has its radial width and the thin channel 23 of FIG. 6 has its axial depth enlarged in the direction rotation.

As has been described in detail hereinbefore, according to the present invention, by forming the thin channel communicating with the discharge chamber, the oil corresponding to the reduction in the capacity of the sealed space is progressively released through said thin channel into the discharge chamber. As a result, the sealed space is prevented from abruptly communicating with the discharge chamber so that the backflow of the oil from the discharge chamber into the sealed space can be prevented so as to suppress generation of pressure fluctuations. This makes it possible to prevent the occurrence of noises and tooth wear, which might otherwise have raised the serious problem in the prior art.

Obviously, numerous modifications and variations of the present invention are possible in light of the above teachings. It is therefore to be understood that within the scope of the appended claims, the invention may be practiced otherwise than as specifically described herein.

What is claimed is:

1. A trochoidal oil pump comprising:

a housing defining an internal space;

an outer rotor fitted rotatably in the internal space of said housing and having internal teeth;

an inner rotor having outer teeth meshing with the internal teeth of said outer rotor to define a sealed space therebetween; and suction and discharge chambers formed in said housing and opened into an internal space of the housing, wherein said discharge chamber is formed so as to begin at an angle l in the direction of forward rotation taken from the dedendum of said inner rotor and defined by the following relationship:

$$l_1 < l \leqq 70°$$

where $l_1$ designates an angle taken in the forward direction of rotation from the dedendum of said inner rotor to a first contact position at which a top portion of said teeth of said outer rotor and said inner rotor contact at said first position at which a maximum volume of said sealed space occurs; and wherein said housing has an arcuate shaped thin channel formed therein communicating with said discharge chamber so as to extend in a reverse direction of rotation from the position of said angle l so as to communicate with said maximum volume of said sealed space for progressively releasing oil in said sealed space and for preventing said maximum volume of said sealed space from abruptly communicating with said discharge chamber so that a back flow of oil from said discharge chamber into said maximum volume of said sealed space can be blocked.

2. A trochoidal oil pump according to claim 1, wherein said thin channel is shaped in the form of a slot.

3. A trochoidal oil pump according to claim 1, wherein said thin channel is shaped to have an effective sectional area thereof enlarged in the forward direction of rotation.

4. A trochoidal oil pump according to claim 3, wherein said thin channel is shaped to have a width dimension thereof enlarged in the forward direction of rotation.

5. A trochoidal oil pump according to claim 3, wherein said thin channel is shaped to have a depth dimension thereof enlarged in the forward direction of rotation.

* * * * *

UNITED STATES PATENT AND TRADEMARK OFFICE

CERTIFICATE OF CORRECTION

PATENT NO. : 4,767,296

DATED : August 30, 1988

INVENTOR(S) : Atsushi SATOMOTO et al.

It is certified that error appears in the above-identified patent and that said Letters Patent is hereby corrected as shown below:

Column 1, line 56, after "(i.e.," insert --in--;

and at Column 3, line 68, after "direction" insert --of--.

Signed and Sealed this

Fourth Day of April, 1989

*Attest:*

*Attesting Officer*

DONALD J. QUIGG

*Commissioner of Patents and Trademarks*